US011091890B2

(12) United States Patent
Bergendahl et al.

(10) Patent No.: US 11,091,890 B2
(45) Date of Patent: Aug. 17, 2021

(54) CABLE GUARDRAIL SAFETY SYSTEM

(75) Inventors: Peter Bergendahl, Ängelholm (SE); Gregory A. Neece, Midlothian, TX (US); Brian Smith, Dallas, TX (US)

(73) Assignee: TRINITY INDUSTRIES, INC., Dallas, TX (US)

( * ) Notice: Subject to any disclaimer, the term of this patent is extended or adjusted under 35 U.S.C. 154(b) by 0 days.

(21) Appl. No.: 13/233,479

(22) Filed: Sep. 15, 2011

(65) Prior Publication Data

US 2013/0069026 A1 Mar. 21, 2013

(51) Int. Cl.
*E01F 15/06* (2006.01)
*E04H 17/12* (2006.01)

(52) U.S. Cl.
CPC ..... *E01F 15/06* (2013.01); *E04H 17/12* (2013.01); *Y10T 29/49826* (2015.01)

(58) Field of Classification Search
CPC . E01F 15/00; E01F 15/02; E01F 15/06; E01F 15/065; E01F 15/0461; E01F 15/025; E04H 17/02; E04H 17/12; Y10T 29/49826
USPC ..... 256/1, 13.1, 32
See application file for complete search history.

(56) References Cited

U.S. PATENT DOCUMENTS

| | | | | |
|---|---|---|---|---|
| 5,039,066 | A * | 8/1991 | Stacey | 256/13.1 |
| 6,065,738 | A * | 5/2000 | Pearce et al. | 256/13.1 |
| 6,948,703 | B2 * | 9/2005 | Alberson et al. | 256/13.1 |
| 6,962,328 | B2 * | 11/2005 | Bergendahl | 256/13.1 |
| 7,249,908 | B2 * | 7/2007 | Bergendahl et al. | 404/6 |
| 7,497,640 | B2 * | 3/2009 | Sharp et al. | 404/6 |
| 2002/0014620 | A1 * | 2/2002 | Nilsson | 256/59 |
| 2007/0102689 | A1 * | 5/2007 | Alberson et al. | 256/13.1 |
| 2008/0272352 | A1 | 11/2008 | Gripne et al. | 256/13.1 |
| 2009/0218554 | A1 * | 9/2009 | Mauer et al. | 256/13.1 |

FOREIGN PATENT DOCUMENTS

| | | | |
|---|---|---|---|
| EP | 0369659 | 11/1989 | E01F 15/00 |
| EP | 1158102 | 5/2001 | E01F 15/06 |
| GB | 1103873 | 9/1965 | E01F 15/00 |
| WO | WO03/102310 | 12/2003 | E01F 15/06 |

OTHER PUBLICATIONS

Notification of Transmittal of the International Search Report and the Written Opinion of the International Searching Authority, or the Declaration; International Application No. PCT/US2012/054367, dated Dec. 5, 2012.

(Continued)

*Primary Examiner* — Matthew R McMahon
(74) *Attorney, Agent, or Firm* — Baker Botts, LLP

(57) ABSTRACT

A safety barrier comprises a plurality of posts spaced from each other and disposed adjacent to a roadway, each post having a cross section defined in part by a web and a pair of legs extending therefrom. Additionally, each post has one slot formed in the web of the post extending from an upper end of the post. A first cable and a second cable are releasably engaged with and supported by the posts and disposed within each slot between the respective legs of each post. A third cable and a fourth cable are each coupled to an exterior surface of the posts. The posts and the first, second, third and fourth cables cooperate to prevent a vehicle from leaving the roadway.

19 Claims, 7 Drawing Sheets

(56) References Cited

OTHER PUBLICATIONS

International Preliminary Report on Patentability; PCT/US2012/054367; pp. 8, dated Mar. 27, 2014.
First Office Action issued by the Mexican Patent Office for Mexican Patent Application No. MX/a/2014/003141 (both Spanish and English)—dated Aug. 22, 2016.
Office Action issued by the Canadian Patent Office for Canadian Patent Application No. 2848375, dated Mar. 13, 2018; 4 pages.
Second Office Action issued by the Mexican Patent Office for Mexican Patent Application No. MX/a/2014/003141 (both Spanish and English)—dated May 18, 2017.
First Office Action issued by the Mexican Patent Office for Mexican Patent Application No. MX/a/2014/003141 (both Spanish and English)—dated Jan. 16, 2018.
Office Action for Mexican Patent Application No. MX/a/2014/003141, dated Oct. 1, 2018; 8 pages.
Office Action for Canadian Patent Application No. 2848375, dated Dec. 6, 2018; 4 pages.
Office Action for United Arab Emirates Patent Application No. 0235/2014, dated Oct. 17, 2018; 15 pages.
Office Action for Canadian Patent Application No. 2848375, dated Aug. 7, 2019; 5 pages.
Office Action for Mexican Patent Application No. MX/a/2014/003141, dated Dec. 17, 2020; 17 pages.
Office Action for Canadian Patent Application No. 2848375, dated Apr. 9, 2020; 5 pages.
Office Action for Mexican Patent Application No. MX/a/2014/003141, dated Apr. 15, 2021; 25 pages.

* cited by examiner

CABLE GUARDRAIL SAFETY SYSTEM

TECHNICAL FIELD OF THE INVENTION

The present invention is related to highway barriers and safety systems and more particularly to cable safety systems and associated posts.

BACKGROUND OF THE INVENTION

Cable safety systems and cable barriers have been installed along edges of roadways and highways for many years. Cable safety systems and cable barriers have also been installed along medians between roadways and/or highways. Cable safety systems generally include one or more horizontal cables attached to support posts. For some applications cable safety systems and cable barriers may reduce damage to an impacting vehicle and/or injury to occupants of the impacting vehicle as compared with other types of highway safety systems and highway barriers.

Cable safety systems are often designed and installed with three cables mounted horizontally on a plurality of generally vertical support posts. The number of cables may vary depending on various factors such as the type of vehicles using the associated roadway and the hazard which required installation of the cable safety system. The length of a cable safety system is generally determined based on the adjacent roadside hazard. Each cable is typically installed at a desired height relative to the ground and with a desired spacing between adjacent cables. Associated support posts are installed with desired horizontal spacing between adjacent posts.

One recognized limitation of cable safety systems is excessive deflection of associated cables during vehicle impact. Deflection associated with a cable safety system may be larger than deflection of a convention W-beam guardrail when subjected to the same type of vehicle impact. Such deflection frequently determines maximum allowed spacing between adjacent posts for satisfactory performance of the cable safety system. Large deflection during a vehicle impact also increases the risk of the vehicle running over the cables and being exposed to the hazard which required installation of the cable safety system.

From full scale crash testing and from real life experience, it has been determined that keeping the length of unsupported cables as short as possible will generally reduce deflection. The longer the distance between adjacent posts supporting associated cables, the larger the deflection will generally be during a vehicle impact. An increased number of posts (shorter post spacing) will generally decrease deflection. However, shorter spacing between posts affects total cost of a cable safety system, not only material, but also installation cost.

High-speed films from full-scale crash testing of vehicles with cable safety systems demonstrate that posts installed immediately adjacent to the location of a vehicle impact with unsupported portions of the cables will bend and/or deform in response to forces placed on the posts by the cables. When a post is bent at an angle of about ten (10°) degrees from vertical, the upper cable of a typical three cable safety system will often slide out of its associated slot or hook and lose its retaining capabilities. After another couple of degrees of the post bending from vertical, the second cable will slide out of its associated slot or hook. Finally, the third cable will slide out of its associated slot or hook when the post is bent about twenty eight to thirty (28° to 30°) degrees from normal. When the cables are released from posts adjacent to the point of vehicle impact, deflection of the cables will increase significantly.

Vertical spacing between cables, vertical spacing of the cables relative to the associated roadway and horizontal spacing between adjacent posts are preferably designed and selected to allow the resulting cable safety system to satisfactorily function during a vehicle impact. Desired vertical spacing between cables and vertical spacing of cables relative to the ground may be obtained in a number of ways by using spacers, hooks, straps or other devices. The number of times an installer has to go to each post is of major concern since this not only takes time, but more importantly, exposes installers to the risk of being injured by traffic. Additional care must be taken with respect to design and installation of cable safety systems adjacent to curves in a highway or roadway and adjacent to inclines or slopes.

During the past several years, cable safety systems have been used as an alternative to traditional W-beam guardrail systems. These cable safety systems address some of the weaknesses of prior cable safety systems by using prestressed cables and/or reducing the spacing between adjacent posts to reduce deflection to an acceptable level. A consultant report "Dynamic Analysis of Cable Guardrail" issued in April 1994 by an ES-Consult in Denmark, established a model for which parameters affect performance and designing desired deflection of cable safety systems.

SUMMARY OF THE INVENTION

In accordance with particular embodiments of the present disclosure, the disadvantages and problems associated with cable guardrail safety systems have been substantially reduced or eliminated.

In accordance with particular embodiments of the present disclosure, a safety barrier comprises a plurality of posts spaced from each other and disposed adjacent to a roadway, each post having a cross section defined in part by a web and a pair of legs extending therefrom. Additionally, each post has one slot formed in the web of the post extending from an upper end of the post. The safety barrier further comprises a first cable and a second cable releasably engaged with and supported by the posts and disposed within each slot between the respective legs of each post. The safety barrier further comprises a third cable and a fourth cable each coupled to an exterior surface of the posts. Each slot has a first edge and a second edge with respective sloping surfaces operable to slid ably receive the first cable and the second cable therein. The sloping surfaces on the first edge of each slot provide a first projection and the sloping surfaces on the second edge of each slot provide a second projection. The posts and the first, second, third and fourth cables cooperate to prevent a vehicle from leaving the roadway.

In accordance with another embodiment of the present disclosure, a post for installing a cable safety system comprises a cross section defined in part by a web and a pair of legs extending from the web. The post also comprises a first end and a second end with a slot formed in the web starting at the first end an extending partially along the length of the post, the second end configured to be installed adjacent to a roadway. The slot has a first edge and a second edge and is sized to receive a first cable and a second cable therein. The post further comprises at least one restriction defined in part by respective sloping surfaces formed on each edge of the slot to increase retention time of the first cable and the second cable within the slot as the post is bent from a generally vertical position during a vehicle impact with the cables disposed within the slot. The post also comprises a first fastener coupled to a first exterior surface of the post, the first fastener size to receive a third cable and a second fastener coupled to a second exterior surface of the post, the second fastener sized to receive a fourth cable. The post also comprises at least one spacer disposed within the cross section of the post operable to maintain the cables at a desired spacing within the slot.

In accordance with yet another embodiment of the present disclosure, a method of installing a cable safety system comprises forming a plurality of posts with each post having a slot extending from an upper end of the post. The method also includes forming the slot with a first edge and a second edge. Additionally, the method includes forming respective tapered surfaces on the first edge to provide a first projection and forming respective tapered surfaces on the second edge to provide a second projection. The method also includes forming at least one restriction within each slot defined in part by the first projection extending from the first edge and the second projection extending from the second edge to increase retention of the cables within the slot as the respective posts are bent from a generally vertical position. The method further includes installing the plurality of posts spaced from each other proximate to the roadway. The method further includes releasably engaging a first cable and a second cable within the respective slot formed in each of the posts and coupling a third cable and a fourth cable to an exterior surface of the posts.

In accordance with yet another embodiment of the present disclosure, a method for manufacturing a support post for a cable safety system comprises forming a post with a first end and second end. The method also includes forming the post with a cross section defined in part by a web and a pair of legs extending therefrom. The method also includes forming a slot in the web extending from the first end of the post and forming the slot with a first edge and second edge. The method further includes forming respective tapered surfaces on the first edge to provide a first projection and respective tapered surfaces on the second edge to provide a second projection, the first projection extending from the first edge and the second projection extending from the second edge to increase retention of a first cable and a second cable in the slot as the post bends from a generally vertical position during a vehicle impact with the cable safety system. The method also includes forming at least one spacer disposed within the cross section of the post operable to maintain at least a first cable and a second cable at a desired spacing within the slot.

Technical advantages provided by particular embodiments of the present disclosure include providing a cable safety system that maintains engagement between posts and associated cables for a longer period of time as the posts are bent from a generally vertical position during a vehicle impact. A cable safety system incorporating teachings of the present invention also minimizes the number of times an installer has to go to each post to position associated cables at desired heights relative to each other and an adjacent roadway. The present invention reduces both the cost and the time required to install a cable safety system.

Technical advantages provided by particular embodiments of the present disclosure further include enabling cables and a metal portion of a support post to interact more quickly. This enables vehicles be more effectively redirected away from away from hazardous areas by enabling cables to provide resistance to vehicles impacting cable safety system sooner after impact.

Moreover, because of the innovative support post, a support post may be manufactured at a reduced cost compared with previous designs. In particular, the inclusion of four cables in cable safety system allows for a shorter overall height of support post. The inclusion of an additional cable connected to the support post at an appropriate height enables the top-most cable to be positioned higher relative to ground level than previous systems. A higher overall cable height enables a support post to be shorter overall. Additionally, the inclusion of four cables allows for the use of a thinner web in support post. Further, a cable safety system may be manufactured without punching holes in the bottom of support post, which may substantially reduces the manufacturing cost of support post.

In combination with four cables and other aspects of cable safety system, the smaller and thinner size of support post is effective to improve redirection of vehicles away from hazardous areas without causing serious injuries to the vehicle's occupants or other motorists. A smaller post in combination with a three-cable design would not have performed as effectively because a three-cable design may be less effective at preventing vehicles from summarizing or passing through cable safety system as compared to a four-cable design. A combination of a smaller and thinner support post may enable a support post to be manufactured at a weight of 5.7 pounds per foot, compared with a weight of 7.7 pounds per foot for previous designs, thereby enabling substantial cost savings during manufacture and maintenance.

As a result, particular embodiments of the present disclosure may provide numerous technical advantages. Particular embodiments the present disclosure may provide some, none, all, or additional technical advantages.

BRIEF DESCRIPTION OF THE DRAWINGS

A more complete and thorough understanding of the present invention and advantages thereof may be acquired by referring to the following description taken in conjunction with the accompanying drawings, in which like reference numbers indicate like features, and wherein.

DETAILED DESCRIPTION

Figure 1A:
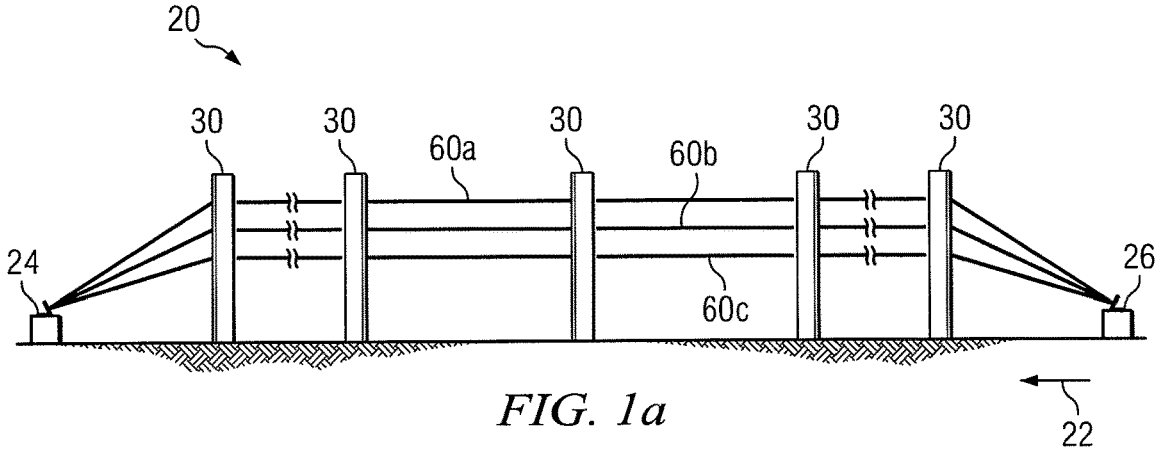
FIG. 1*a* is a schematic drawing in elevation with portions broken away of a cable safety system incorporating teachings of the present invention.
Figure 1B:
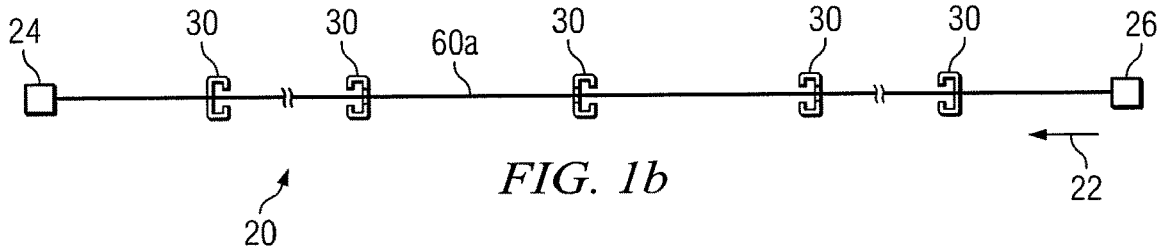
FIG. 1*b* is a schematic drawing showing a plan view with portions broken away of the cable safety system of FIG. 1*a;*
Figure 1C:
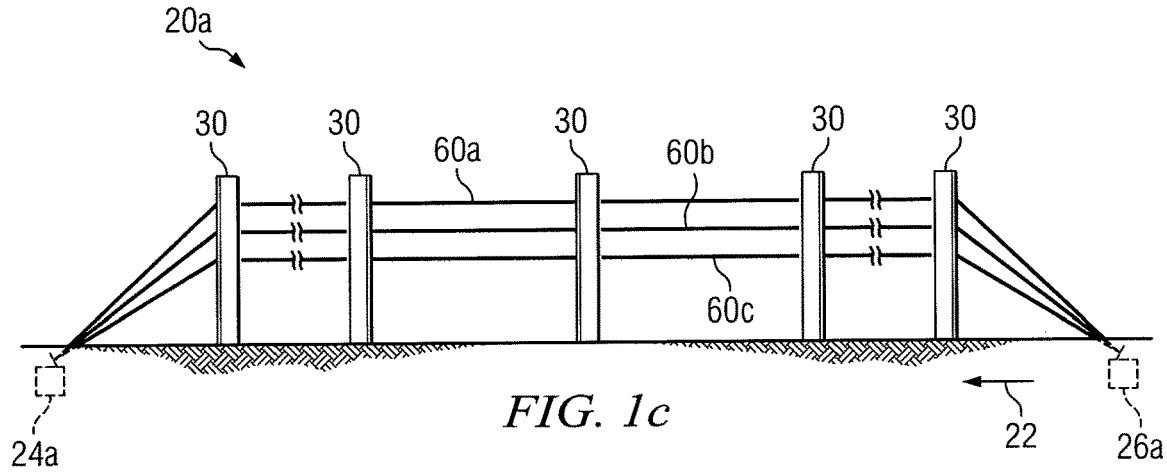
FIG. 1*c* is a schematic drawing in elevation with portions broken away of another cable safety system incorporating teachings of the present invention.

Preferred embodiments of the invention and its advantages are best understood by reference to FIGS. 1A-13B wherein like reference numbers indicate like features.

The terms "safety system or systems" and "barrier or barriers" are used throughout this application to describe any type of safety system and/or barrier which may be formed in accordance with teachings of the present disclosure. The term "roadway" is used throughout this application to include any highway, roadway or path satisfactory for vehicle traffic.

Various aspects of the present disclosure will be described with respect to cable safety system 20. However, teachings of the present disclosure may be used to form a wide variety of cable safety systems and cable barriers. The present disclosure is not limited to cable safety system 20 as shown in FIGS. 1*a*-1*d*.

Cable safety systems incorporating teachings of the present disclosure may be used in median strips or shoulders of highways, roadways or any other path which is likely to encounter vehicular traffic. The present disclosure may be used to form a wide variety of safety systems and barriers installed on a median between roadways and/or along the edge of a roadway. Cable safety system 20 may be installed adjacent to a roadway to prevent motor vehicles (not expressly shown) from leaving the roadway and to redirect vehicles away from hazardous areas without causing serious injuries to the vehicle's occupants or other motorists. The direction of traffic flow along the roadway is illustrated by directional arrow 22.

Cable safety system 20 preferably includes a plurality of support posts 30 anchored adjacent to the roadway. Posts 30 may be anchored with the ground using various techniques. The number, size, shape and configuration of posts 30 may be significantly modified within teachings of the present disclosure. A plurality of cables 60*a*, 60*b* and 60*c* may be attached to support posts 30 in accordance with teachings of the present disclosure. Support posts 30 support and maintain associated cable 60*a*, 60*b* and 60*c* in a substantially horizontal position extending along an edge of the roadway. The length of cables 60*a*, 60*b* and 60*c* may be up to 3,000 meters between anchors 24 and 26. For other applications the length of cable 60*a*, 60*b* and 60*c* may exceed 3,000 meters without an intermediate anchorage. Support posts 30 also maintain desired vertical spacing between cables 60*a*, 60*b* and 60*c* and desired vertical spacing of each cable relative to the ground. Cable safety system 20 including support posts 30 satisfy the criteria of CHIRP Report 350 including Level 3 requirements.

Cable safety system 20 may be described as a flexible, substantially maintenance free system with designed low deflection of cables 60*a*, 60*b*, and 60*c* during a vehicle impact. Support posts 30 preferably include a "rounded" and "soft" profile with cables 60*a*, 60*b* and 60*c* placed within respective posts 30. Forming cables safety system 20 in accordance with teachings of the present disclosure minimizes damage during a vehicle impact with cables 60*a*, 60*b* and 60*c*. In some embodiments, cable safety system 20 includes three cables 60*a*, 60*b* and 60*c* disposed in slot 40 of each post 30. Cable 60*a*, 60*b* and 60*c* are preferably disposed at different heights relative to the ground and relative to each other. Varying the vertical spacing between cables 60*a*, 60*b* and 60*c* provides a much wider lateral catch area for vehicles impacting with cable safety system 20. The vertical spacing between cables 60*a*, 60*b* and 60*c* may be selected to satisfactorily contain both pickups and, to some extent, even larger vehicles with a relatively high center of gravity, as well as vehicles with a low front profile and low center of gravity. Cable safety system 20 may be satisfactorily used as a median, a single barrier installation along the edge of a roadway and at merge applications between adjacent roadways. For some applications cable safety system 20 may satisfactorily withstand a second impact before repairs have been made after a first impact.

Various types of cables and/or wire ropes may be satisfactorily used to form a cable safety system in accordance with teachings of the present disclosure. Cables 60*a*, 60*b* and 60*c* may be substantially identical. However, for some applications each cable of a cable safety system formed in accordance with teachings of the present disclosure may have different characteristics.

Cables 60*a*, 60*b* and 60*c* may be prefabricated in approximately three hundred (300) meter lengths with desired fittings (not expressly shown) attached with opposite ends of each cables 60*a*, 60*b* and 60*c*. Tailor-made cables 60*a*, 60*b* and 60*c* may then be delivered to a desired location for installation adjacent to a roadway.

Alternatively, cables 60*a*, 60*b*, and 60*c* may be formed from a single cable stored on a large drum (not expressly shown). Cables stored on drums may often exceed three thousand (3,000) meters in length. Cables 60*a*, 60*b*, and 60*c* may be cut in desired lengths from the cable stored on the drum. Appropriate fittings (not expressly shown) may be swaged or otherwise attached with opposite ends of the respective cable 60*a*, 60*b* and 60*c* at an onsite location.

For some applications cable 60 may be formed from three groups of seven strands of wire rope. Cable 60 may have a modulus of elasticity of approximately 8,300 kg per square mm. The diameter of each strand used to form cable 60 may be approximately 3 mm. The diameter of cable 60 may be approximately 19 mm. Cables 60*a*, 60*b* and 60*c* may be pre-stressed to approximately fifty percent (50%) of their designed or rated breaking strength. Cables 60*a*, 60*b* and 60*c* may be installed between anchors 24 and 26 with approximately twenty thousand Neutrons of tension over a length of approximately three thousand (3,000) meters.

Figure 1D:
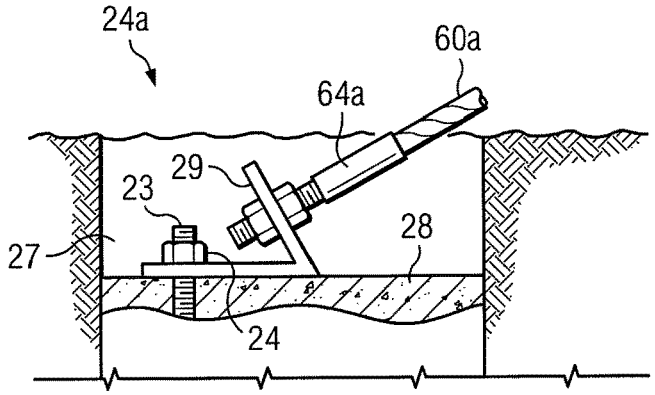
FIG. 1*d* is a schematic drawing in section and in elevation with portions broken away of a below ground cable anchor assembly satisfactory for use with the cable safety system of FIG. 1*c;*
Figure 2:
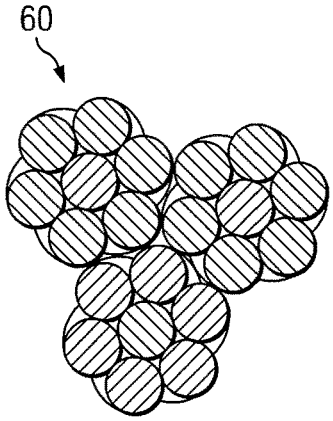
FIG. 2 is a schematic drawing in section showing one example of a cable satisfactory for use in forming a cable safety system incorporating teachings of the present invention.

FIG. 1*d* shows one example of a below ground anchor which may be satisfactorily used with a cable safety system incorporating teachings of the present invention. Respective holes 27 may be formed in the ground at desired locations for anchors 24*a* and 26*a*. A portion of each hole 27 may be filled with concrete foundation 28. Anchor plate 29 may be securely engaged with concrete foundation 28 using various types of mechanical fasteners, including, but not limited to, a plurality of bolts 23 and nuts 24. Anchor plate 29 may be formed at an appropriate angle to accommodate the design of cable safety system 20*a*. Also multiple slots and/or openings (not expressly shown) may be formed in anchor plate 29 to receive respective end fittings 64*a*.

For the embodiment of the present invention as shown in FIG. 1*d*, end fitting 64*a* of cable 60*a* is shown engaged with anchor plate 29. Various types of anchor assemblies and cable end fittings may be satisfactorily used with a cable safety system incorporating teachings of the present invention. The present invention is not limited to anchor 24*a* or end fittings 64*a* as shown in FIG. 1*d*.

Figure 3:
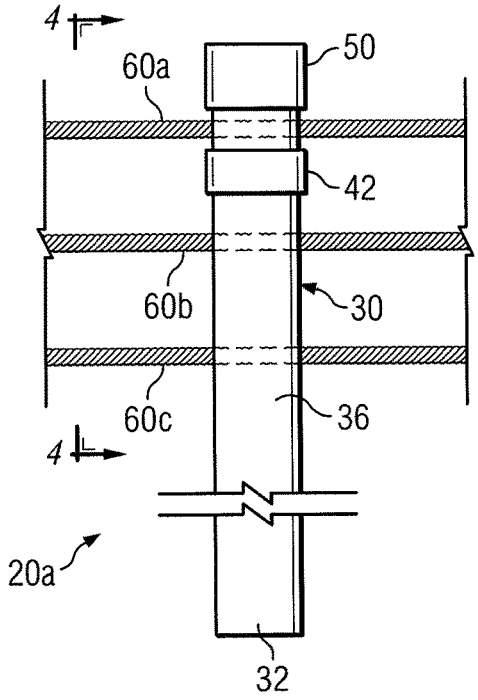
FIG. 3 is a schematic drawing in elevation with portions broken away showing one example of a post and attached cables incorporating teachings of the present invention.
Figure 4:
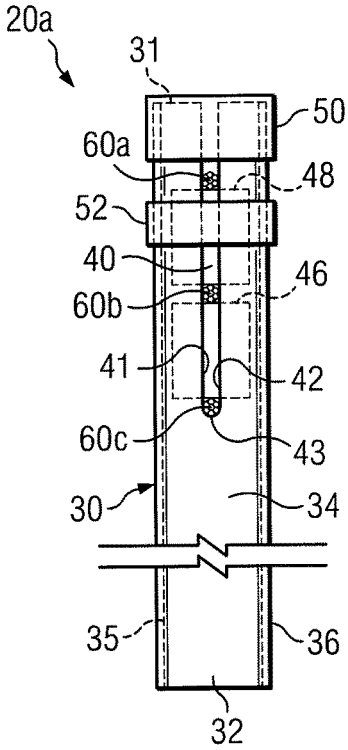
FIG. 4 is a schematic drawing taken along lines 4-4 of FIG. 3.
Figure 5:
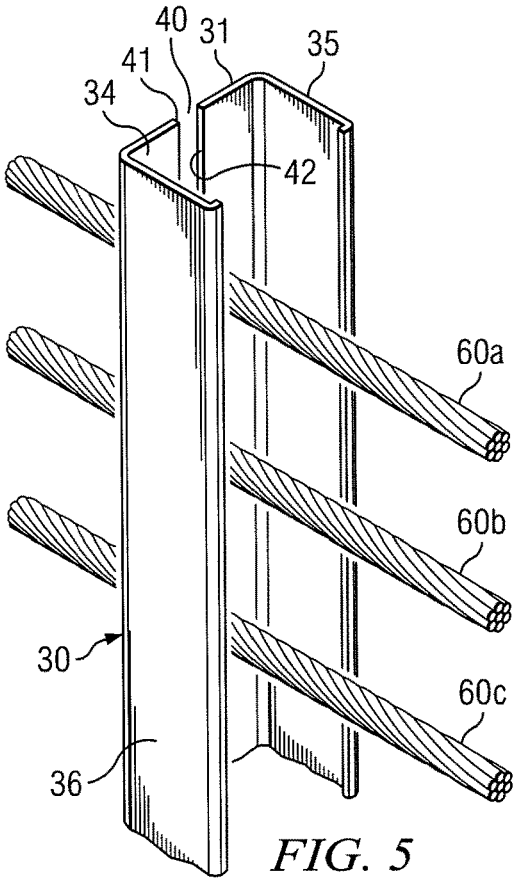
FIG. 5 is an enlarged schematic drawing showing an isometric view with portions broken away of a post and cables incorporating teachings of the present invention.
Figure 7:
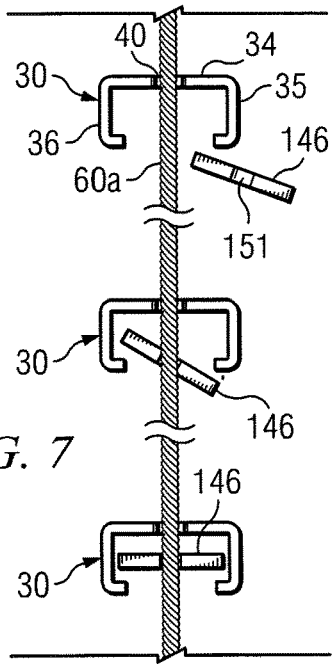
FIG. 7 is a schematic drawing showing one method for installing the spacer of FIG. 6 with the post and cables of FIG. 5.
Figure 8A:
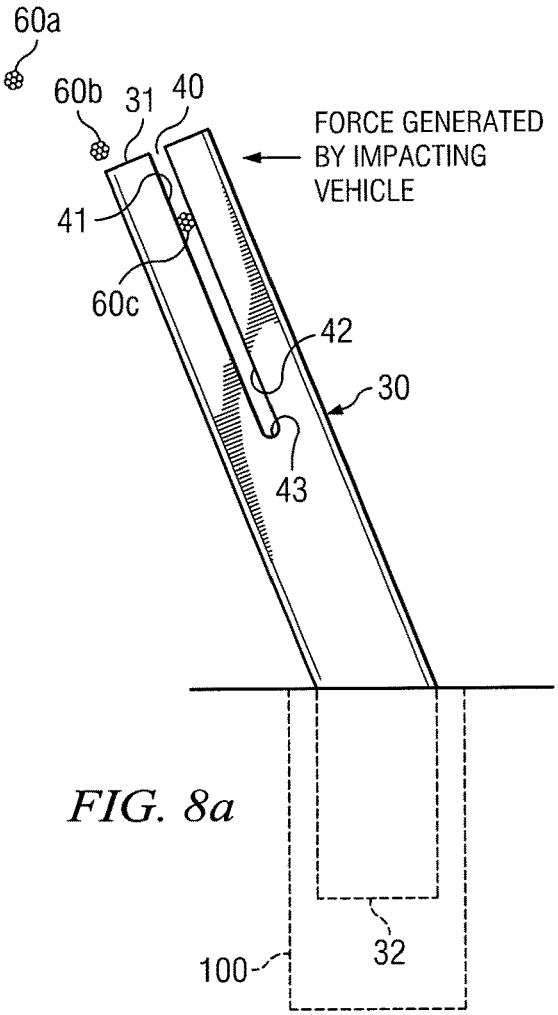
FIG. 8*a* is a schematic drawing in section and in elevation showing one example of the results of a vehicle impacting a cable safety system.
Figure 8B:
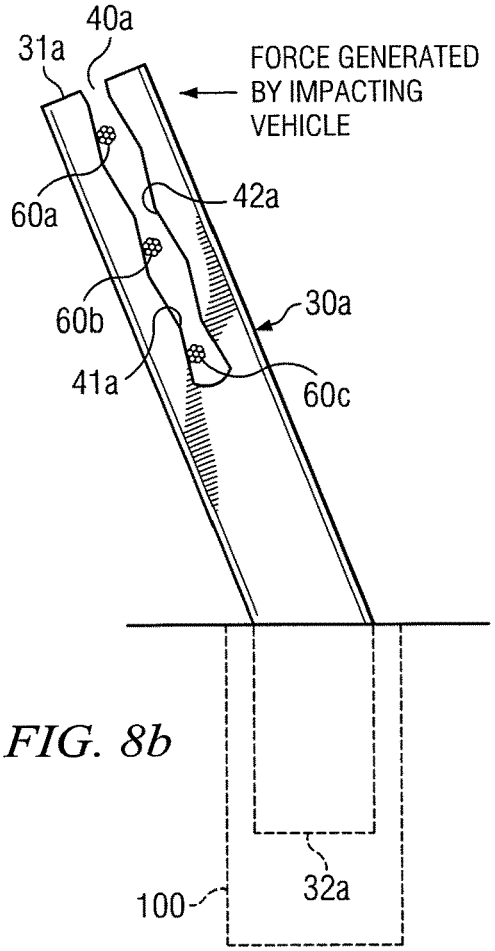
FIG. 8*b* is a schematic drawing in section and in elevation showing one example of the results of a vehicle impacting a cable safety system incorporating teachings of the present invention.

One example of support posts 30 and cables 60*a*, 60*b* and 60*c* which may be satisfactorily used to form cable safety system 20 in accordance with teachings of the present disclosure is shown in FIGS. 3, 4 and 5. Post 30 includes first end 31 and second end 32. For this embodiment of the present disclosure, post 30 has a generally C-shaped cross section defined in part by web 34 with respective legs 35 and 36 extending therefrom. As best shown in FIGS. 5 and 7, the extreme edge of each leg 35 and 36 opposite from web 34 are preferably bent inward to eliminate any sharp edges. For some applications post 30 may be formed using roll forming techniques. For some applications second end 32 may be installed in a concrete foundation or footing 100 such as shown in FIGS. 8*a* and 8*b*. Alternatively second end 32 may be inserted directly into the ground. One or more soil plates (not expressly shown) may be attached to post 30 proximate second end 32 when post 30 is installed directly into the ground adjacent to a roadway.

Slot 40 is preferably formed in web 34 extending from first end 31 towards second end 32. The length of slot 40 is selected in part based on the desired vertical spacing of cable 60*c* relative to the adjacent roadway. The length of slot 40 is also selected to accommodate the number of cables which will be installed therein and desired vertical spacing between each cable. Slot 40 may have a generally elongated U-shaped configuration defined in part by first edge 41, second edge 42 and bottom 43. For the embodiment of the present disclosure as shown in FIGS. 3-5, first edge 41 and second edge 42 have a generally smooth profile and extend generally parallel with each other. In some embodiments, forming slot 40 within web 34 of post 30 may eliminate bolts, hooks or other mechanical attachments formed on the exterior thereof.

For some applications post 30 may be formed from metal sheet having a thickness of 4 mm, a length varying approximately from 700 mm to 1,600 mm, and a width of approximately 350 mm. The metal sheet may weigh approximately 7.8 kg per meter. For other applications post 30 may be formed from a metal sheet having a thickness of 4 mm, a length varying approximately from 700 mm to 1,600 mm, a width of approximately 310 mm and a weight of less 4.5 kg per meter. Post 30 may be installed adjacent to a roadway by either driving directly into the soil adjacent to the roadway or by placing end 32 of post 30 in a concrete foundation. See FIGS. 8*a* and 8*b*. For other applications a foot plate (not expressly shown) may be attached to second end 32 of post 30 for use in bolting or otherwise securely attaching post 30 with a larger foot plate (not expressly shown) cast into a concrete foundation or similar structure adjacent to a roadway.

For some applications cap 50 may be placed on first end 31 of post 30. Retaining band 52 may be placed on the exterior of post 30 to provide additional strength. Retaining band 52 may be formed from various types of metals and/or composite materials. For some applications retaining band 52 may be formed from a relatively strong steel alloy to provide additional support to allow post 30 to handle side impact forces on edges 41 and 42 from cables 60*a*, 60*b* and 60*c* during a vehicle impact.

During installation of cable safety system 20, cable 60*c* may be disposed within slot 40 resting on bottom 43 thereof. Since post 30 has a generally closed cross section defined in part by the bent edges of legs 35 and 36, a relatively simple first spacer block 46 may be inserted or dropped into post 30 to rest upon cable 60*c*. Block 46 may have a generally rectangular configuration with a thickness satisfactory for insertion within the cross section of post 30. For some applications spacer block 46 may be formed from recycled material. The height of spacer block 46 is selected to correspond with the desired vertical spacing between cable 60*c* and 60*b*.

Cable 60*b* may then be inserted into slot 40 after spacer block 46 has been disposed on cable 60*c*. Second spacer block 48 may then be installed within post 40 with one end resting on cable 60*b* opposite from spacer block 46. The height of second spacer block 48 is preferably selected to correspond with the desired vertical spacing between cables 60*b* and 60*a*. Spacer block 48 may be formed from recycles material.

Cable 60*a* may then be installed within slot 40 resting on spacer block 48 opposite from cable 60*b*. One or more retaining bands 52 may be secured with the exterior of post 40 between cables 60*a* and 60*b* and/or cables 60*b* and 60*c*. Cap 50 may then be placed over first end 31 of post 30.

Figure 6:
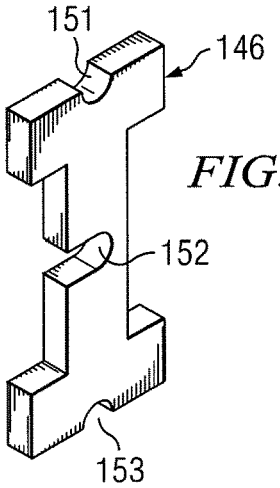
FIG. 6 is a schematic drawing showing an isometric view of one example of a spacer incorporating teachings of the present invention.

FIG. 6 shows a single spacer 146 which may be satisfactorily used to position cable 60*a*, 60*b* and 60*c* at a desired vertical spacings relative to each other within slot 40. For the embodiment of the present disclosure as shown in FIG. 6, spacer 146 has a generally I-shaped configuration. Recesses 151 and 153 may be formed in opposite ends of spacer 146. Another recess 152 may be formed in one edge of spacer 146 intermediate the ends thereof. The dimensions of recess 151, 152 and 153 are selected to accommodate cable 60*a*, 60*b* and 60*c*. The distance between recess 151, 152 and 153 are selected to correspond with the desired vertical spacing between corresponding cable 60*a*, 60*b* and 60*c*.

Spacer 146 may be formed from a wide variety of materials including polymeric materials, elastomeric materials, recycled materials, structural foam materials, composite materials, wood and/or lightweight metal alloys. For some applications spacer 146 may be formed from recycled rubber and/or other recycled plastic materials. The present invention is not limited to forming spacer 146 from any specific type of material or with any specific dimensions or configurations.

Typical installation procedures for a cable safety system incorporating teachings of the present invention includes installing posts 30 along with anchors 24 and 26 or anchor 24*a* and 26*a* at desired locations adjacent to a roadway and/or median (not expressly shown). Cables 60*a*-60*d* may be rolled out and placed on the ground extending generally longitudinally between anchors 24 and 26 or anchors 24*a* and 26*a*. Spacers 146, retaining bands 52 and end caps 50 may also be placed adjacent to each post 30 as desired for the specific installation. Cables 60*a*-60*d* may include prefabricated fittings satisfactory for engagement with anchors 24 and 26 or anchors 24*a* and 26*a*. Alternatively, appropriate fittings (not expressly shown) may be attached with each end of respective cables 60*a*-60*d*.

One end of each cables 60*a*-60*d* may be connected with a respective first anchor. Appropriate tension may then be applied to each cable 60*a*-60*d* corresponding to a value of approximately 95% of the desired tension depending upon anticipated ambient temperature and other environmental conditions. Each cable 60*a*-60*d* may then be marked, cut and an appropriate fitting attached. The other end or the second end of each cable may then be coupled with a respective second anchor. Conventional procedures may be used to adjust the tension in cables 60*a*-60*d* to the desired values. Appropriate spacers 146 may then be inserted within each post 30. Retaining bands 52 and end caps 50 may then be attached to each post.

For some applications, cable 60*a*, 60*b* and 60*c* may be attached with anchor 24 and extended horizontally through each slot 40 formed in the associated support post 30. A respective spacer may then be inserted into each support post 30 to provide desired vertical spacing between cables 60*a*, 60*b* and 60*c*. FIG. 7 is a schematic drawing which shows one example of installing spacer 146 within post 30 after cables 60*a*, 60*b* and 60*c* have been placed within slot 40.

FIG. 8*a* is a schematic drawing which shows the results of a vehicle impact with cables 60*a*, 60*b* and 60*c* adjacent to post 30. The force of the impacting vehicle will tend to bend post 30 from a generally vertical position towards a horizontal position. As previously noted, cables 60*a*, 60*b* and 60*c* will tend to slide from or be released from associated slot 40 as the angle of bending of post 30 from a vertical position increases. One aspect of the present disclosure includes forming one or more restrictions within each slot to help retain associated cables within the slot when a vehicle impacts the associated safety barrier. For example, support post 30*a* is shown in FIG. 8*b* with cable 60*a*, 60*b* and 60*c* retained within slot 40*a* by restrictions formed along edges 41*a* and 42*a*. As a result of the restrictions formed within slot 40*a*, cables 60*a*, 60*b* and 60*c* will be retained within slot 40*a* when post 30*a* is bent at the same angle from vertical as post 30. See FIG. 8*b*.

Figure 9:
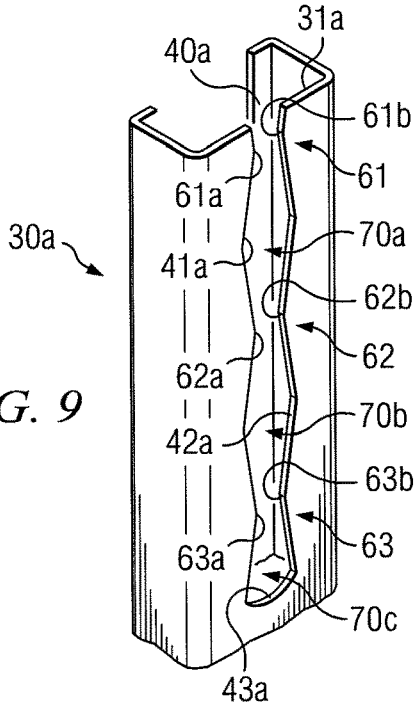
FIG. 9 is a schematic drawing in elevation with portions broken away showing another example of a post formed in accordance with teachings of the present invention.
Figure 10A:
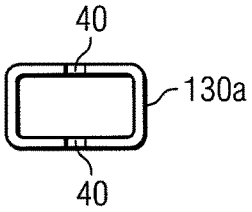
FIGS. 10A-10I are schematic drawings in section showing further examples of posts incorporating teachings of the present invention.
Figure 10B:
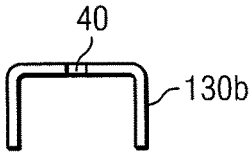
Figure 10C:
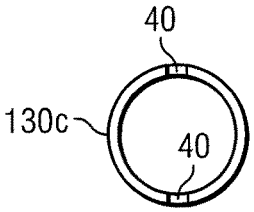
Figure 10D:
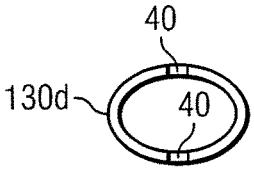
Figure 10E:
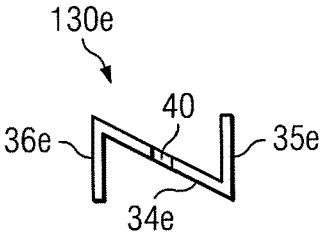
Figure 10F:
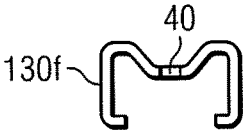
Figure 10G:
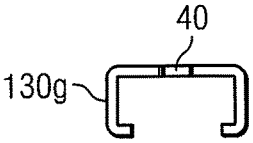
Figure 10H:
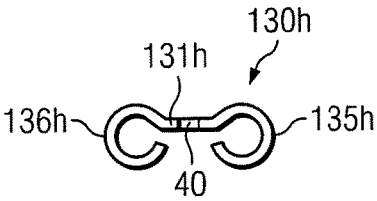
Figure 10I:
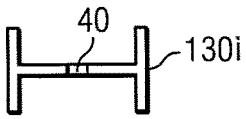

FIG. 9 is an enlarged schematic drawing showing post 30*a* having slot 40*a* form thereon with a plurality of restrictions and/or projections formed in each edge 41*a* and 42*a*. For the embodiment of the present disclosure as shown in FIG. 9 the location and configurations of the restrictions formed in edges 41*a* and 42*a* are selected to correspond generally with the desired location for associated cables 60*a*, 60*b* and 60*c*.

FIGS. 10*a*-10*i* are schematic drawings showing various cross sections for support posts incorporating teachings of the present disclosure. Post 130*a*, 130*c*, 130*d*, 130*f*, 130*g* and 130*h* do not have any sharp edges exposed to vehicle traffic traveling along an adjacent roadway. Slots 40 may be formed in each post 130*a*-130*h* to receive respective cables therein.

Figure 11:
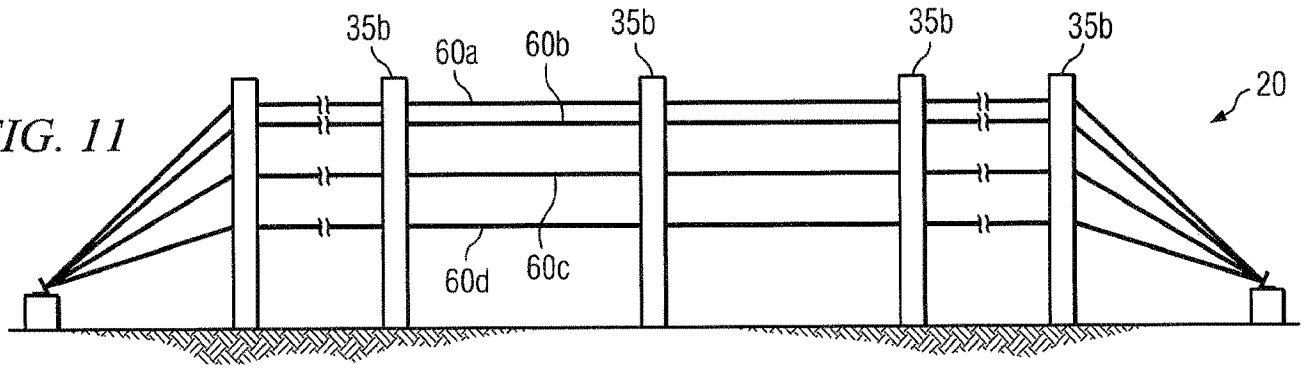
FIG. 11 is a schematic drawing of a particular embodiment of cable safety system utilizing four cables.

FIG. 11 is a schematic drawing of a particular embodiment of cable safety system 20 utilizing four cables 60 to improve the prevention of motor vehicles from leaving the roadway and the redirection of vehicles away from hazardous areas without causing serious injuries to the vehicle's occupants or other motorists. In particular, cables 60*a*, 60*b*, 60*c*, and 60*d* of cable safety system 20 may prevent or reduce the likelihood of a low profile vehicle passing under cable safety system 20 in the event of an impact, while also minimizing the risk of higher-profile vehicles from passing over or through cable safety system 20. The use of four cables 60 provides numerous advantages, including enabling a shorter and thinner support post 30 design, as well as enabling the cost-effective capture of more and varied types of vehicles upon impact with cable safety system 20.

Figure 12B:
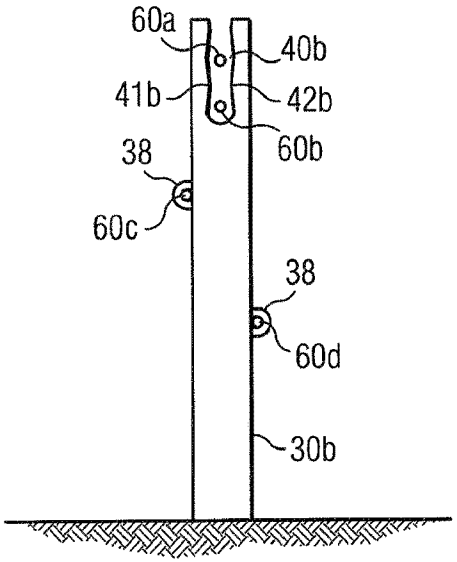
FIGS. 12A and 12B are schematic drawings showing particular embodiments of a support post utilized in certain embodiments of a cable safety system.
Figure 12A:
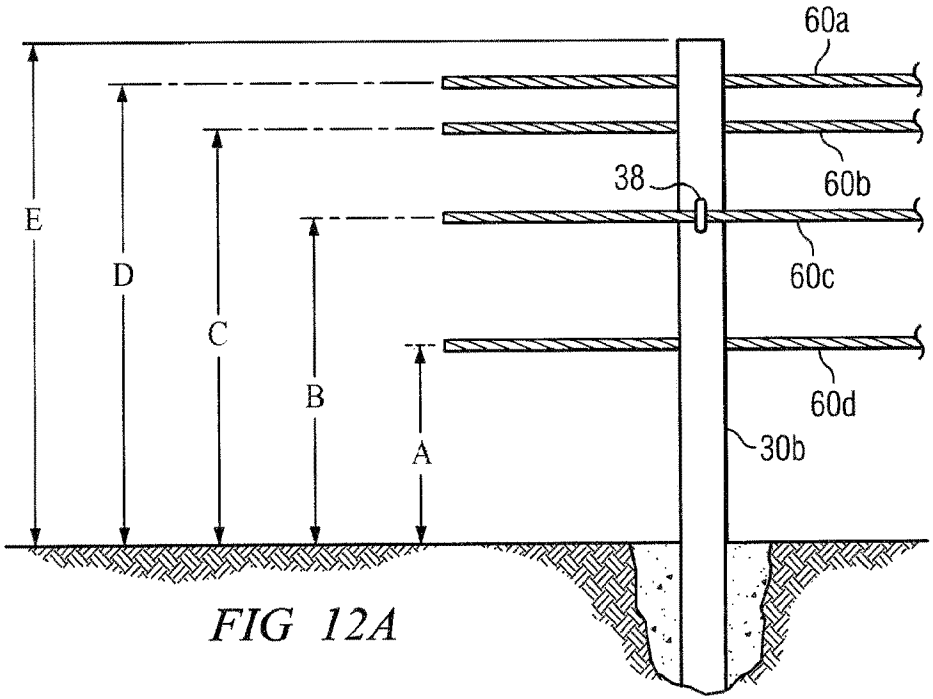

FIGS. 12A and 12B are schematic drawing showing a particular embodiment of support post 30*b* utilized in certain embodiments of cable safety system 20. FIG. 12 shows support post 30*b* that accommodates four cables 60 (cables 60*a*, 60*b*, 60*c*, and 60*d*). Cables 60*a* and 60*b* are positioned in slot 40*b*. As previously noted, cables 60*a* and 60*b* will tend to slide from or be released from associated slot 40 as the angle of bending of post 30 from a vertical position increases. One aspect of the present disclosure includes forming one or more restrictions within each slot to help retain associated cables within the slot when a vehicle impacts the associated safety barrier. For example, support post 30*b* is shown in FIGS. 12A and 12B with cable 60*a* and 60*b* retained within slot 40*b* by restrictions formed along edges 41*b* and 42*b*. As a result of the restrictions formed within slot 40*b*, cables 60*a* and 60*b* will be retained within slot 40*b* when support post 30*b* is bent at the same angle from vertical as support post 30*b*.

FIGS. 12A and 12B also show a particular embodiment of support post 30*b* in which cables 60*c* and 60*d* are positioned on the outside of support post 30*b* using fastener 38. Fastener 38 may represent an eye bolt, hook bolt, or other suitable retainer for cable 60. In an installed configuration, cable 60*c* may be positioned on the side of support post 30*b* closest to the roadway. Cable 60*d* may be positioned on the opposite of support post 30*b* on which cable 60*c* is installed. That is, cable 60*d* may be positioned on a side of support post 30*b* closest to a median between roadways. For example, cable safety system 20 may be installed on or near a median between a southbound roadway and a northbound roadway. Cable 60*c* is advantageously positioned on support post 30*b* to prevent or reduce the likelihood of a northbound vehicle on the northbound roadway from crossing into the median upon impact with cable safety system 20, and heading into southbound traffic on the southbound roadway. Cable 60*d* is advantageously positioned on support post 30*b* to prevent or reduce the likelihood of a southbound vehicle on the southbound roadway from submarining, or passing under, cable safety system 20 and heading into northbound traffic.

Cables 60*a*, 60*b*, 60*c*, and 60*d* may be advantageously positioned along relative heights of support post 30*b* to minimize the risk of vehicles passing over, under, or through cable safety system 20. In particular, from the lowest cable to the highest cable, cable 60*d* may be positioned at a distance A of approximately six inches (6") to one foot (1') from ground level. Cable 60*c* may be positioned at a distance B of approximately six inches (6") to two feet (2') from ground level. Cable 60*b* may be positioned at a distance C of approximately two inches (2") to three feet (3') from ground level. Cable 60*a* may be positioned at a distance D of approximately six inches (6") to three feet (3') from ground level. A top of support post 3*b* may be positioned at a distance E of approximately ten inches (10") to three feet (3') from ground level. Advantageously placing cables 60 along these relative vertical positions of support post 30*b* may prevent or reduce the likelihood of lower-profile vehicles, such as subcompact cars, from submarining, or passing under, cable safety system 20. Further, higher-profile vehicles, such as pickup-trucks and vans, may be prevented from passing over, or through cable safety system 10.

Figure 13A:
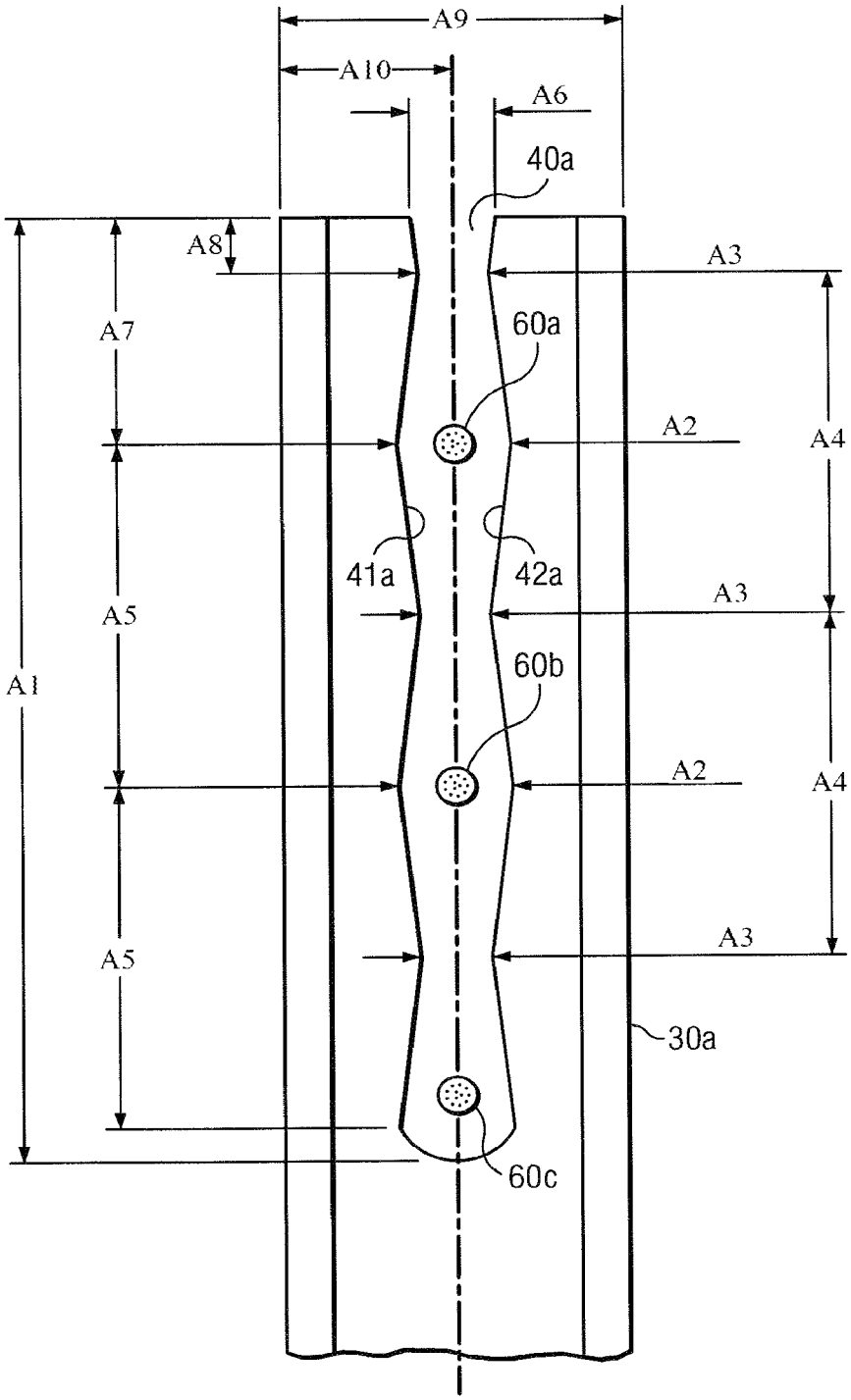
FIGS. 13A and 13B show schematic views of slots positioned in a support post, in accordance with particular embodiments of the present disclosure.
Figure 13B:
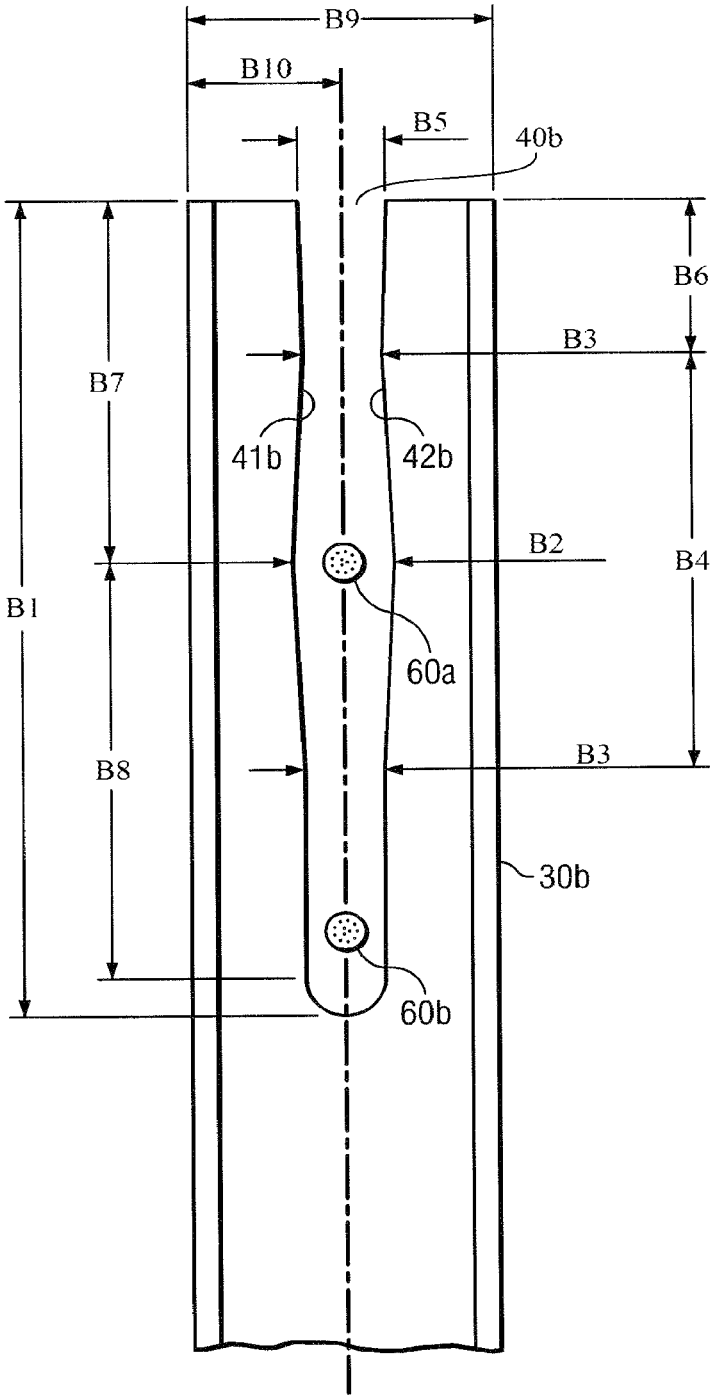

FIGS. 13A and 13B show schematic views of slots 40*a* and 40*b* positioned in support posts 30*a* and 30*b*, respectively. FIG. 13*a* shows slot 40*a* suitable for use in a three-cable cable safety system 20. Slot 40*a* accommodates cables 60*a*, 60*b* and 60*c*. In particular embodiments, slot 40*a* may be open at a top end, positioned at the top of post 30*a*, and may have an overall length A1 of eleven and thirteen sixteenths inches (11 13/16"). Slot 40*a* may be a distance A2 of one and three-eighths inches (1⅜ ") wide at its widest extent, and may include three restrictions formed along edges 41*a* and 42*a* that are each a distance A3 of thirteen sixteenths inches (13/16") wide. As shown in FIG. 13A, cables 60*a*, 60*b*, and 60*c* are each positioned in one of the areas of widest extent between the restrictions. The vertical distance A4 between each restriction may be four and five sixteenths inches (4 5/16"), and a vertical distance A5 between each of the areas of widest extent between the restrictions may be four and five sixteenths inches (4 5/16"). An opening of slot 40*a* may be a length A6 of fifteen sixteenths inches (15/16"), a distance from the area of widest extent that is closest to the opening, to the opening, may be a distance A7 of two and twenty-five thirty-seconds inches (2 25/32"), and a distance from the restriction that is closest to the opening, to the opening, may be a distance A8 of five eighths inches (⅝"). In this configuration, support post 30*a* may be a distance A9 of four inches (4") wide, with a distance A10 from the center of slot 40*a* to an edge of post 30*a* of two inches (2").

FIG. 13B shows a slot 40*b* suitable for use in a four-cable cable safety system 20. Slot 40*b* accommodates cables 60*a* and 60*b*. Two additional cables (such as, for example, cables 60*c* and 60*d*) may be positioned on the outside of support post 30*b*, as discussed above. In particular embodiments, slot 40*b* may be open at a top end, positioned at the top of support post 30*b*, and may have an overall length B1 of eight and one-half inches (8½"). Slot 40*b* may be a distance B2 of one inch (1") wide at its widest extent, and may include two restrictions formed along edges 41*b* and 42*b* that are each a distance B3 of thirteen sixteenths inches (13/16") wide. One cable of cables 60*a* and 60*b* may each be positioned in one of the areas of widest extent between the restrictions. The other cable of cables 60*a* and 60*b* may be positioned at an area approximately equal to the width of the restrictions (i.e., the area of narrowest extent). The vertical distance B4 between each restriction may be four and five sixteenths inches (4 5/16"). An opening of slot 40*b* at the top of support post 30*b* may be a distance B5 of fifteen sixteenths inches (15/16") wide. A vertical distance B6 between the restriction closest to the opening to the opening may be one and five eighths inches (1⅝"), and a vertical distance B7 between the area of widest extent to the opening may be three and twenty-five thirty-seconds inches (3 25/32"). A vertical distance B8 between the area of widest extent to the area approximately equal to the width of the restrictions at an end opposite to the opening may be four and five sixteenths inches (4 5/16"). In this configuration, support post 30*b* may be a distance B9 of three inches (3") wide, with a distance B10 from the center of slot 40*b* to an edge of support post 30*b* of one and one-half inches (1½").

As compared with slot 40*a*, slot 40*b* has narrower width between edges 41*b* and 42*b* in which cables 60 are positioned. This reduced distance between edges 41*b* and 42*b* allows for cables 60 and support post 30*b* to interact more quickly in the manner described above with respect to FIG. 8. Because cables 60 and support post 30*b* are able to start working more quickly in slot 40*b* (as compared to cables 60 in slot 40*a* and post 30*a*), vehicles may be more effectively redirected away from away from hazardous areas by enabling cables 60 to provide resistance to vehicles impacting cable safety system 20 sooner after impact.

Moreover, because of the smaller overall dimensions of support post 30*b*, support post 30*b* may be manufactured at a reduced cost compared with previous designs. In particular, the inclusion of four cables 60 in cable safety system 20 allows for a shorter overall height of support post 30*b*. A fourth cable 60 enables the top-most cable 60 to be positioned higher relative to ground level than previous systems. A higher overall cable height enables support post 30*b* to be shorter overall. Additionally, the inclusion of four cables 60 may allow for the use of a thinner web in support post 30*b*. Additionally, cable safety system 20 may be manufactured without punching holes in the bottom of support post 30, which may substantially reduces the manufacturing cost of support post 30*b*.

In combination with four cables 60 and other aspects of cable safety system 20, the smaller and thinner size of support post 30*b* is effective to improve redirection of vehicles away from hazardous areas without causing serious injuries to the vehicle's occupants or other motorists. A smaller post in combination with a three-cable design would not have performed as effectively because cable safety system 20 would have been less effective at preventing vehicles from submarining or passing through cable safety system 20 as compared to a four-cable design. A combination of a smaller and thinner support post 30*b* may enable support post 30*b* to be manufactured at a weight of 5.7 pounds per foot, compared with a weight of 7.7 pounds per foot for previous designs, thereby enabling substantial cost savings during manufacture and maintenance.

A typical installation process in accordance with particular embodiments of the present disclosure is now described. Posts 30 and anchors 24 and 26 are installed at desired location adjacent to a roadway and/or median. Cables are rolled out and spacers are placed, retaining the band and cap at each post. Cables are connected with appropriate fittings if the cables do not include prefabricated fittings. One end of each cable is connected with anchor 26. Each cable is tensioned to a value of approximately 95% of the desired tension depending upon temperature and other environmental conditions. Each cable is marked, and an appropriate fitting is cut and attached. Each end of the respective cables is connected with the second anchor 26. The tension in the is adjusted cables to a desired level. Spacers are installed within each post. A retaining band and cap is attached at each post.

Although embodiments of the present disclosure and their advantages have been described in detail, it should be understood that various changes, substitutions and alternations can be made herein without departing from the spirit and scope of the invention as defined by the following claims.

What is claimed is:

1. A safety barrier comprising:

a plurality of posts spaced from each other and disposed between a roadway and a median separating the roadway from another roadway, each post of the plurality of posts comprising an I-beam weighing approximately 5.7 pounds per foot of length, a first bolt, and a second bolt, the I-beam of each post comprising a first leg, a second leg, and a web extending between the first leg and the second leg, wherein:

a first edge of the web is coupled to an interior surface of the first leg along a midline of the interior surface of the first leg between a first edge of the first leg and a second edge of the first leg opposite the first edge of the first leg;

a second edge of the web opposite the first edge of the web is coupled to an interior surface of the second leg along a midline of the interior surface of the second leg between a first edge of the second leg and a second edge of the second leg opposite the first edge of the second leg;

the post has one slot formed in the web of the post extending from an upper end of the post;

a first end of the first bolt is coupled to an exterior surface of the first leg at a position on the exterior surface of the first leg generally midway between the first edge of the first leg and the second edge of the first leg and at a first height above ground level, the first bolt extending from the exterior surface of the first leg in a direction generally perpendicular to the exterior surface of the first leg, the first bolt terminating at a second end in at least one of a hook and a ring; and a first end of the second bolt is coupled to an exterior surface of the second leg at a position on the exterior surface of the second leg generally midway between the first edge of the second leg and the second edge of the second leg and at a second height above ground level that is lower than the first height, the second bolt extending from the exterior surface of the second leg in a direction generally perpendicular to the exterior surface of the second leg, the second bolt terminating at a second end in at least one of a hook and a ring;

a first cable and a second cable releaseably engaged with and supported by the plurality of posts and disposed within each slot between the respective legs of each post, the first cable and the second cable each having a diameter of approximately nineteen millimeters;

a third cable coupled to the at least one of the hook and the ring of the first bolt of each of the plurality of posts; and a fourth cable coupled to the at least one of the hook and the ring of the second bolt of each of the plurality of posts, wherein:

each slot has a first edge and a second edge with respective sloping surfaces operable to slidably receive the first cable and the second cable therein, and only the first cable and second cable are disposed within each slot, wherein within each slot the first cable and the second cable are vertically spaced relative to each other above ground level such that the second cable is lower than the first cable, wherein each slot is approximately one inch wide at its widest extent;

the sloping surfaces on the first edge of each slot provide a plurality of first projections;

the sloping surfaces on the second edge of each slot provide a plurality of second projections;

at most two restrictions are formed within each slot, each of the two restrictions defined by a first projection of the plurality of first projections extending from the first edge and a second projection of the plurality of second projections extending from the second edge;

the posts and the first, second, third and fourth cables cooperating to prevent a vehicle from leaving the roadway;

the first cable is disposed in a first area between the first edge and the second edge of each slot;

the second cable is disposed in a second area between the first edge and the second edge of each slot;

a distance from the first edge to the second edge in the first area is greater than a distance from the first edge to the second edge in the second area;

each slot is formed in the post at a height above ground level that is higher than both the first height and the second height;

the third cable extends along a same first side of each post, and the fourth cable extends along a same second side of each post; and the exterior surface of the first leg of each post is disposed closer to the roadway than the exterior surface of the second leg of each post and the exterior surface of the second leg of each post is disposed closer to the median than the exterior surface of the first leg of each post.

2. The safety barrier of claim 1, further comprising at least one spacer disposed within the cross section of each post to maintain the first cable and the second cable at desired locations within the respective slot.

3. The safety barrier of claim 1 wherein the two restrictions help retain the first cable and the second cable in the slot as the associated post is bent by a vehicle colliding with the safety barrier.

4. The safety barrier of claim 1, further comprising at least one retaining band secured to the exterior of each post to aid in releasably engaging the cables with the associated post.

5. The safety barrier of claim 1 further comprising a respective cap releasably secured with an upper end of each post.

6. The safety barrier of claim 1 wherein the two restrictions are configured to retain the first cable and the second cable disposed within each slot in the respective slots; and a respective first spacer is disposed within each post between the first cable and the second cable.

7. The safety barrier of claim 1, wherein the first height above ground level is approximately two feet and six inches above ground level; and the second height above ground level is approximately one foot and five and seven eighths inches above ground level.

8. The safety barrier of claim 1, wherein the first cable is positioned in the slot approximately three feet and six inches above ground level; and the second cable is positioned in the slot approximately three feet and two inches above ground level.

9. The safety barrier of claim 1, wherein the first and second projections are opposed to each other within the slot and form a narrow portion of the slot, the narrow portion having a width of approximately thirteen sixteenths inches wide.

10. The safety barrier of claim 1, wherein the slot has a length of approximately eight and one-half inches.

11. A set of posts including a plurality of posts for installing a cable safety system, each of the plurality of posts comprising an I-beam of weighing approximately 5.7 pounds per foot of length, a first bolt, and a second bolt, the I-beam comprising a first leg, a second leg, and a web extending between the first leg and the second leg, wherein, for each of the plurality of posts:

a first edge of the web is coupled to an interior surface of the first leg along a midline of the interior surface of the first leg between a first edge of the first leg and a second edge of the first leg opposite the first edge of the first leg;

a second edge of the web opposite the first edge of the web is coupled to an interior surface of the second leg along a midline of the interior surface of the second leg between a first edge of the second leg and a second edge of the second leg opposite the first edge of the second leg;

a slot is formed in the web starting at a first end of the post and extending partially along the length of the post;

a second end of the post is configured to be installed adjacent to a roadway;

the slot has a first edge and a second edge;

the slot is sized to receive a first cable and a second cable therein, and only the first cable and second cable are disposed within the slot, the first cable and the second cable each having a diameter of approximately nineteen millimeters, wherein within each slot the first cable and the second cable are vertically spaced relative to each other above ground level such that the second cable is lower than the first cable, wherein each slot is approximately one inch wide at its widest extent;

at most two restrictions defined in part by respective sloping surfaces formed on each edge of the slot to increase retention time of the first cable and the second cable within the slot as the post is bent from a generally vertical position during a vehicle impact with the cables disposed within the slot;

a first end of the first bolt is coupled to an exterior surface of the first leg at a position on the exterior surface of the first leg generally midway between the first edge of the first leg and the second edge of the first leg and at a first height above ground level, the first bolt extending from the exterior surface of the first leg in a direction generally perpendicular to the exterior surface of the first leg, the first bolt terminating at a second end in at least one of a hook and a ring that is configured to receive a third cable;

a first end of the second bolt is coupled to an exterior surface of the second leg at a position on the exterior surface of the second leg generally midway between the first edge of the second leg and the second edge of the second leg and at a second height above ground level that is lower than the first height, the second bolt extending from the exterior surface of the second leg in a direction generally perpendicular to the exterior surface of the second leg, the second bolt terminating at a second end in at least one of a hook and a ring that is configured to receive a fourth cable; and at least one spacer disposed within a cross section of the post operable to maintain the cables at a desired spacing within the one slot;

the first cable is disposed in a first area between the first edge and the second edge of the slot;

the second cable is disposed in a second area between the first edge and the second edge of the slot;

a distance from the first edge to the second edge in the first area is greater than a distance from the first edge to the second edge in the second area;

the slot is formed in the post at a height above ground level that is higher than both the first height and the second height;

the post is disposed between the roadway and a median separating the roadway from another roadway; and the exterior surface of the first leg of the post is disposed closer to the roadway than the exterior surface of the second leg of the post and the exterior surface of second leg of the post is disposed closer to the median than the exterior surface of the first leg of the post.

12. The set of posts of claim 11, wherein the one slot comprises:

a generally elongated U-shaped configuration defined in part by the first edge, the second edge and a bottom opposite from the first end of the post.

13. The set of posts of claim 11, wherein the first height above ground level is approximately two feet and six inches above ground level; and the second height above ground level is approximately one foot and five and seven eighths inches above ground level.

14. The set of posts of claim 11, wherein the first cable is configured to be positioned in the slot approximately three feet and six inches above ground level; and the second cable is configured to be positioned in the slot approximately three feet and two inches above ground level.

15. The set of posts of claim 11, wherein the at most two restrictions comprise a first and second restriction, the first and second restrictions opposing each other within the slot and forming a narrow portion of the slot, the narrow portion having a width of approximately thirteen sixteenths inches wide.

16. The set of posts of claim 11, wherein the slot has a length of approximately eight and one-half inches.

17. A method of installing a cable safety system comprising:

forming a plurality of posts, each post of the plurality of posts having a slot extending from an upper end of the post, and comprising an I-beam weighing approximately 5.7 pounds per foot of length, a first bolt, and a second bolt, the I-beam of each post comprising a first leg, a second leg, and a web extending between the first leg and the second leg, wherein:

a first edge of the web is coupled to an interior surface of the first leg along a midline of the interior surface of the first leg between a first edge of the first leg and a second edge of the first leg opposite the first edge of the first leg;

a second edge of the web opposite the first edge of the web is coupled to an interior surface of the second leg along a midline of the interior surface of the second leg between a first edge of the second leg and a second edge of the second leg opposite the first edge of the second leg;

a first end of the first bolt is coupled to an exterior surface of the first leg at a position on the exterior surface of the first leg generally midway between the first edge of the first leg and the second edge of the first leg and at a first height above ground level, the first bolt extending from the exterior surface of the first leg in a direction generally perpendicular to the exterior surface of the first leg, the first bolt terminating at a second end in at least one of a hook and a ring; and a first end of the second bolt is coupled to an exterior surface of the second leg at a position on the exterior surface of the second leg generally midway between the first edge of the second leg and the second edge of the second leg and at a second height above ground level that is lower than the first height, the second bolt extending from the exterior surface of the second leg in a direction generally perpendicular to the exterior surface of the second leg, the second bolt terminating at a second end in at least one of a hook and a ring;

forming each slot with a first edge and a second edge, wherein each slot is approximately one inch wide at its widest extent;

forming respective tapered surfaces on the first edge to provide a plurality of first projections;

forming respective tapered surfaces on the second edge to provide a plurality of second projections;

forming at most two restrictions within each slot, each of the at most two restrictions defined in part by a first projection of the plurality of first projections extending from the first edge and a second projection of the plurality of second projections extending from the second edge to increase retention of a plurality of cables within the slot as the respective posts are bent from a generally vertical position;

installing the plurality of posts spaced from each other proximate to a roadway;

releasably engaging only a first cable and a second cable within the respective slot formed in each of the posts, the first cable and the second cable each having a diameter of approximately nineteen millimeters, wherein within each slot the first cable and the second cable are vertically spaced relative to each other above ground level such that the second cable is lower than the first cable;

coupling a third cable to the at least one of the hook and the ring of the first bolt of each of the plurality of posts; and coupling a fourth cable to the at least one of the hook and the ring of the second bolt of each of the plurality of posts, wherein:

the first cable is disposed in a first area between the first edge and the second edge of each slot;

the second cable is disposed in a second area between the first edge and the second edge of each slot;

a distance from the first edge to the second edge in the first area is greater than a distance from the first edge to the second edge in the second area;

each slot is formed in the post at a height above ground level that is higher than both the first height and the second height;

the third cable extends along a same first side of each post, and the fourth cable extends along a same second side of each post;

each post of the plurality of posts is disposed between the roadway and a median separating the roadway from another roadway; and the exterior surface of the first leg of each post is disposed closer to the roadway than the exterior surface of the second leg of each post and the exterior surface of the second leg of each post is disposed closer to the median than the exterior surface of the first leg of each post.

18. The method of claim 17, further comprising:

placing a first spacer within each post between the first cable and the second cable; and placing a second spacer within each post between the second cable and the third cable.

19. A method for manufacturing a set of posts for a cable safety system comprising:

forming each post of the set of posts with a first end and a second end, each post of the set of posts comprising an I-beam weighing approximately 5.7 pounds per foot of length, the I-beam comprising a first leg, a second leg, and a web extending between the first leg and the second leg, wherein:

a first edge of the web is coupled to an interior surface of the first leg along a midline of the interior surface of the first leg between a first edge of the first leg and a second edge of the first leg opposite the first edge of the first leg; and a second edge of the web opposite the first edge of the web is coupled to an interior surface of the second leg along a midline of the interior surface of the second leg between a first edge of the second leg and a second edge of the second leg opposite the first edge of the second leg;

forming a slot in the web of each post, extending from the first end of each post;

forming each slot with a first edge and second edge, wherein each slot is approximately one inch wide at its widest extent;

forming respective tapered surfaces on the first edge to provide a plurality of first projections and respective tapered surfaces on the second edge to provide a plurality of second projections;

forming at most two restrictions within each slot, each of the two restrictions defined by a first projection of the plurality of first projections extending from the first edge and a second projection of the plurality of second projections extending from the second edge to increase retention of a first cable and a second cable in the slot as the post bends from a generally vertical position during a vehicle impact with the cable safety system, wherein only the first cable and second cable are disposed within the slot, the first cable and the second cable each having a diameter of approximately nineteen millimeters, wherein within the slot the first cable and the second cable are vertically spaced relative to each other above ground level such that the second cable is lower than the first cable;

forming at least one spacer disposed within the cross section of the post operable to maintain the first cable and the second cable at a desired spacing within each slot;

coupling a first bolt to each post, wherein a first end of the first bolt is coupled to an exterior surface of the first leg of the post at a position on the exterior surface of the first leg generally midway between the first edge of the first leg and the second edge of the first leg and at a first height above ground level, the first bolt extending from the exterior surface of the first leg in a direction generally perpendicular to the exterior surface of the first leg, the first bolt terminating at a second end in at least one of a hook and a ring, the at least one of the hook and the ring configured to receive a third cable; and coupling a second bolt to each post, wherein a first end of the second bolt is coupled to an exterior surface of the second leg of the post at a position on the exterior surface of the second leg generally midway between the first edge of the second leg and the second edge of the second leg and at a second height above ground level that is lower than the first height, the second bolt extending from the exterior surface of the second leg in a direction generally perpendicular to the exterior surface of the second leg, the second bolt terminating at a second end in at least one of a hook and a ring, the at least one of the hook and the ring configured to receive a fourth cable, wherein:

the first cable is disposed in a first area between the first edge and the second edge of each the second cable is disposed in a second area between the first edge and the second edge of each a distance from the first edge to the second edge in the first area is greater than a distance from the first edge to the second edge in the second each slot is formed in the post at a height above ground level that is higher than both the first height and the second each post of the set of posts is configured to be disposed between a roadway and a median separating the roadway from another roadway such that the exterior surface of the first leg of each post is disposed closer to the roadway than the exterior surface of the second leg of each post and the exterior surface of the second leg of each post is disposed closer to the median than the exterior surface of the first leg of each post.

* * * * *